United States Patent [19]

Bolton et al.

[11] 4,306,615

[45] Dec. 22, 1981

[54] APPARATUS FOR ASSEMBLING AN AIR CONDITIONING UNIT INCLUDING A TUBE SHEET ISOLATOR

[75] Inventors: Theodore S. Bolton, Liverpool; Richard D. Lang, Chittenango, both of N.Y.

[73] Assignee: Carrier Corporation, Syracuse, N.Y.

[21] Appl. No.: 151,039

[22] Filed: May 19, 1980

[51] Int. Cl.[3] ..... F28F 9/00

[52] U.S. Cl. ..... 165/67; 62/298; 165/69; 165/134 R; 165/149

[58] Field of Search ..... 165/69, 76, 78, 134 R, 165/149, DIG. 8, 67, 150, 172; 62/263, 298, 302

[56] References Cited

U.S. PATENT DOCUMENTS

| | | | |
|---|---|---|---|
| 2,744,393 | 5/1956 | Brugler et al. | 165/149 X |
| 3,415,315 | 12/1968 | Donaldson et al. | 165/69 X |
| 3,742,725 | 7/1973 | Berger | 165/76 X |
| 4,082,142 | 4/1978 | Blackburn et al. | 165/76 |

FOREIGN PATENT DOCUMENTS

| | | | |
|---|---|---|---|
| 509815 | 11/1920 | France | 165/149 |
| 741476 | 12/1955 | United Kingdom | 165/134 |

*Primary Examiner*—Sheldon J. Richter

*Attorney, Agent, or Firm*—J. Raymond Curtin; Robert P. Hayter

[57] ABSTRACT

Apparatus and method for the assembly of an air conditioning unit including a tube sheet isolator. An electrically and thermally insulative isolator is provided for securing an aluminum heat exchanger to a steel component of the unit. The tube sheet isolators further serve to allow various subassemblies of the air conditioning unit to be slidably engaged to secure the components relative to one another.

5 Claims, 5 Drawing Figures

APPARATUS FOR ASSEMBLING AN AIR CONDITIONING UNIT INCLUDING A TUBE SHEET ISOLATOR

BACKGROUND OF THE INVENTION

1. Field of the Invention

This invention relates in general to the assembly of an air conditioning unit. More specifically, this invention relates to a tube sheet isolator used to electrically and thermally insulate an aluminum heat exchanger from a steel supporting component and used to secure various components of the air conditioning unit upon assembly.

2. Prior Art

Air conditioning units which are commonly used for light commercial applications such as hotels, dormitories and office buildings often are of a type known as packaged terminal air conditioning units. These packaged terminal air conditioners extend through the wall of the enclosure and normally have a condensing section located for discharging heat energy to the ambient sink of the atmosphere and an evaporator section located within the enclosure wherein air in the enclosure may be conditioned. These units are usually spaced on an exterior wall of the enclosure to be conditioned located in a specific subenclosure therein.

These units typically have a condensing section in communication with the ambient air. Within the condensing section there is usually a condenser, a condenser fan and a compressor. Additionally, an evaporator section is provided located in communication with the air to be conditioned. The major components of the evaporator section usually include an evaporator, an evaporator fan and controls for the unit. A partition typically separates the condensing section from the evaporator section.

In many applications it is advantageous to manufacture both the evaporator and the condenser from aluminum. It is additionally advantageous to manufacture the internal components of the unit such as a condenser fan shroud, evaporator scroll and partition or other air directing components of the unit from steel. The components are normally assembled such that the air directing components such as the condenser fan shroud and the evaporator scroll are connected to the heat exchangers. The direct connection of steel to aluminum may result in a galvanic action and subsequent corrosion of the materials.

To assemble an air conditioning unit, various subassemblies are typically made and then secured to each other. The tube sheet isolator as disclosed herein aids in positioning one subassembly relative to another. Both heat exchangers may be mounted on the base pan of the unit and then all of the air directing components may be slid into engagement therewith using this isolator. Additionally, the isolator may be manufactured from a thermally insulative as well as dielectric material such that galvanic action between the dissimilar metals is prevented and thermal conduction from the heat exchanger to the air directing components is reduced.

SUMMARY OF THE INVENTION

An object of the present invention is to provide means for securing an air directing component to a heat exchanger in an air conditioning unit.

A further object of the present invention is to secure dissimilar materials, one to the other, while preventing galvanic action therebetween.

Another object of the present invention is to secure a structural component to a heat exchanger with a component which thermally insulates the heat exchanger from the structural component.

A further object of the present invention is to provide a component which may aid in the assembly of the unit by slidably engaging a tube sheet flange extending from the heat exchanger.

It is another object of the present invention to provide a safe, economical, reliable and easy to manufacture tube sheet isolator for securing a steel air directing component to an aluminum heat exchanger.

Other objects will be apparent from the description to follow and the appended claims.

In accordance with the preferred embodiment of the invention, the above objects are achieved by the utilization of a thermally and electrically insulative tube sheet isolator. This tube sheet isolator is a single formed extrusion having a body portion and two leg portions extending therefrom. The space between the two leg portions is utilized as a tube sheet retaining slot to secure a tube sheet therebetween. Additionally, the body portion has screw openings formed therein such that a screw inserted through the structural steel component may secure that component to a portion of the isolator. Hence, when assembled, the screw secures a steel component to the isolator and the tube sheet is secured to the isolator by having a tube sheet flange held within a tube sheet receiving slot. Additionally, the isolator has a flared portion to help engage the tube sheet flange. Upon assembly the air directing components are attached to the isolator which may then slidably engage the tube sheet flange to aid in the assembly of the unit.

DESCRIPTION OF THE PREFERRED EMBODIMENT

The apparatus as described hereinafter will refer to a tube sheet isolator for use in a packaged terminal air conditioning unit. It is to be understood that this tube sheet isolator has like applicability to similar applications in air conditioning units. It is to be additionally understand that although this isolator is described relative to the assembly of certain components to other components in an air conditioning unit, the particular choice of components incorporated in a subassembly is that of the manufacturing designer and is not limited to the embodiment described herein.

Figure 1:
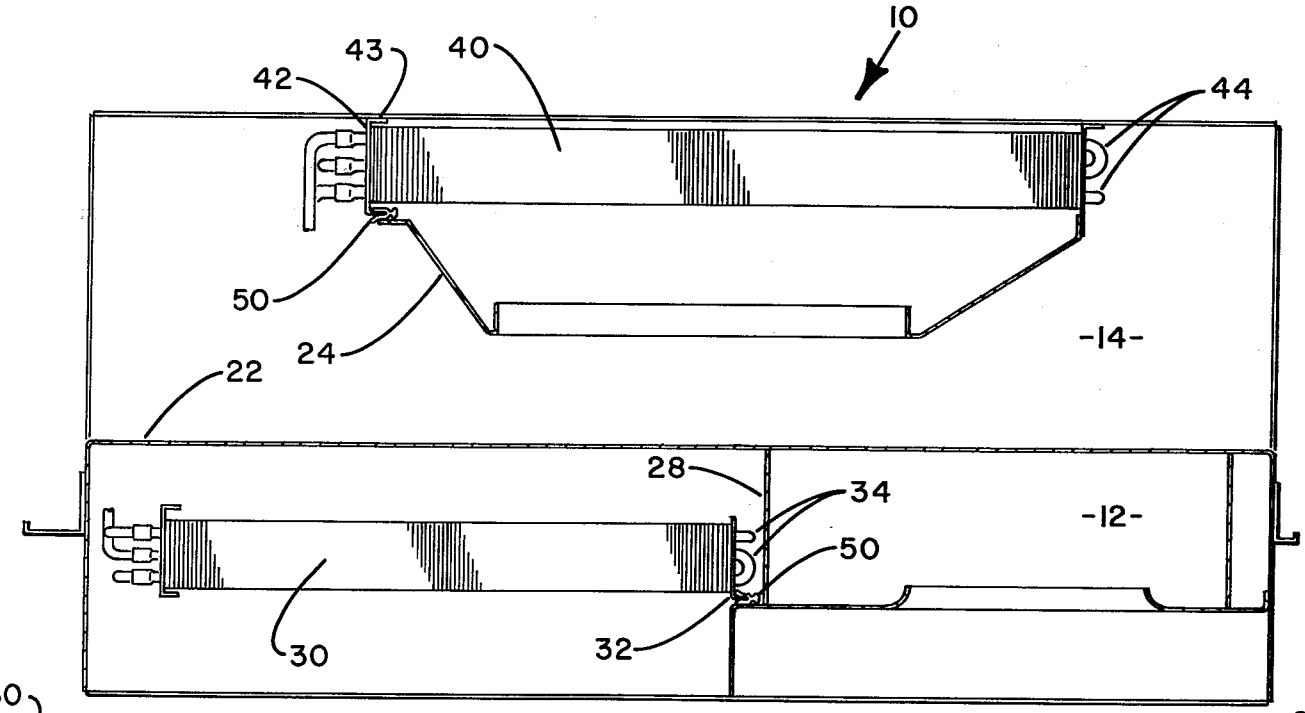
FIG. 1 is a top view of an air conditioning unit showing a portion of the components assembled therein.

Referring now to FIG. 1 there can be seen a partial assembly of air conditioning unit 10 including a base pan on which is mounted condenser 40 and evaporator 30. Partition 22 serves to divide the unit into condensing section 14 and evaporator section 12. Condenser 40 and condenser fan shroud 24 are located within condensing section 14. Additionally, other components which are not shown such as the condensing fan motor and the compressor are conventionally located within the condensing section.

Evaporator 30 is mounted within evaporator section 12 as is the evaporator scroll having evaporator scroll front 26 and evaporator scroll sidewall 28. Additionally, an evaporator fan and the controls portion of the unit are typically mounted within the evaporator section.

Figure 2:
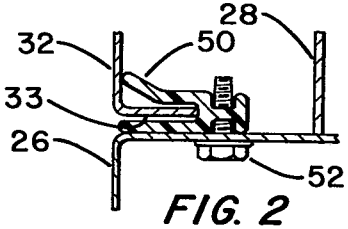
FIG. 2 is an enlarged view of a portion of FIG. 1 showing the isolator engaged to the condenser and the condenser fan shroud.
Figure 3:
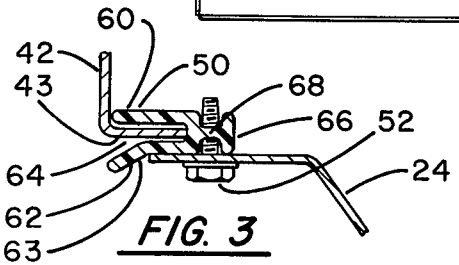
FIG. 3 is an enlarged view of a portion of FIG. 1 showing the isolator engaged to the evaporator and the evaporator scroll.

Isolator 50 is shown securing tube sheet 42 of condenser 40 to condenser fan shroud 24. The tube sheet includes tube sheet flange 43 which is secured within isolator 50. Additionally, a second isolator 50 is shown securing tube sheet flange 33 of tube sheet 32 connected to the evaporator to scroll 26. As can be seen in FIGS. 2 and 3, enlargements of the isolators as shown in FIG. 1, the tube sheet isolator is formed having a body portion 68, straight leg portion 60, flare leg portion 62 and cap 66. Straight leg portion 60 and flare leg portion 62 extend from one side of the body portion in a generally parallel relationship. Flare leg 62 has located at the end distant from the body portion a flare portion 63.

Located between and defined by straight leg 60 and flare leg 62 is tube sheet receiving slot 64. Flare portion 63 is positioned such that receiving slot 64 is wider at the end of the leg portion distant from the body portion such that the insertion of tube sheet flange 43 thereinto is promoted.

Body portion 68 of the isolator may have a screw opening therethrough such that screw 52 inserted through either condenser fan shroud 24 or evaporator scroll front 26 may secure that component, (condenser fan shroud 24 or evaporator scroll front 26, the air directing components of the unit) to the isolator. Cap portion 66 is additionally shown and, as indicated in FIG. 2, may be utilized to abut against a separate internal member of the unit such as evaporator scroll sidewall 28.

As can be seen from FIGS. 2 and 3, the tube sheet isolator may be inverted such that flare portion 63 of flare leg 62 extends in different directions. The flare portion extends outwardly away from the heat exchanger as shown in the condenser application since the tube sheet flange therein extends backwards covering a portion of the heat exchanger. If the flare portion were to extend inwardly it might engage the heat exchanger. In the application to the evaporator, the isolator has been inverted such that the flare portion extends inwardly towards return bends 34 extending from the end of the heat exchanger. The location of the flare portion of the leg further serves to secure the components into position for assembly.

Figure 4:
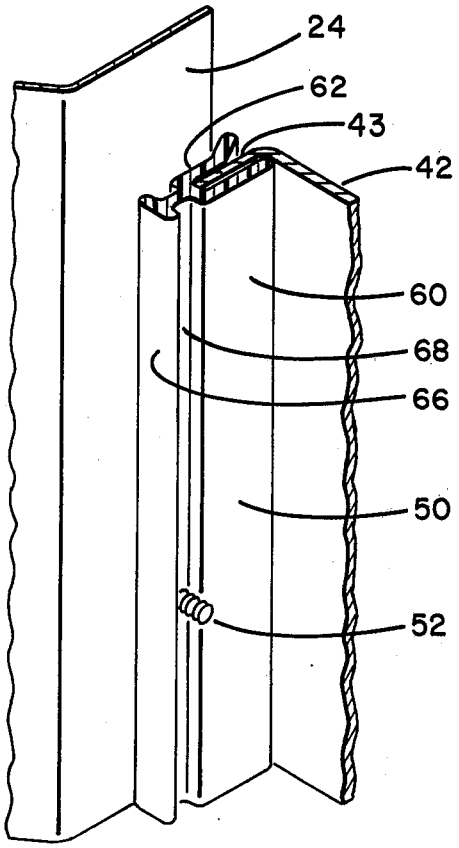
FIG. 4 is an isometric view of a tube sheet and condenser fan shroud attached to an isolator.
Figure 5:
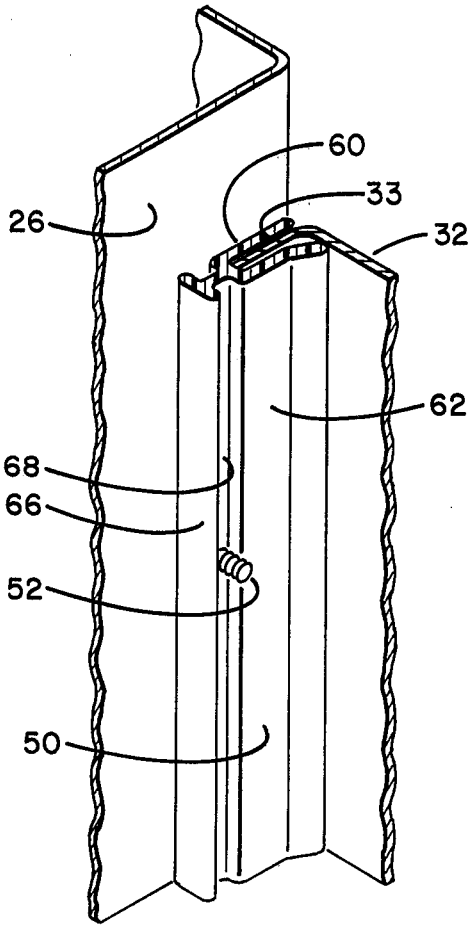
FIG. 5 is an isometric view of the evaporator scroll and tube sheet attached to an isolator.

FIGS. 4 and 5 are isometric views similar to those of FIGS. 2 and 3 showing the isolator engaged to secure the aluminum tube sheet to the steel condenser fan shroud or the evaporator scroll.

The isolator may typically be formed of an extruded plastic which is both thermally and electrically insulative. By the separation of the aluminum tube sheet from the steel component with an electrically insulative material, potential galvanic action therebetween is eliminated. By using a thermally insulative material, the loss of efficiency in the unit by the transfer of heat energy from the heat exchanger to the steel components of the unit is additionally prevented. Screw 52 extends through the body portion of the isolator such that there is no metal to metal contact between the screw and an aluminum tube sheet.

Assembly of the Unit

A subassembly having an evaporator and a condenser mounted to the base pan of the unit is often formed. The air directing components of the unit, such as the condenser fan shroud, the evaporator scroll and the partition may be assembled into a separate component assembly. Fan motors for the condenser fan and evaporator, as well as controls, capacitors and other portions of the unit, may be assembled to the component assembly. Additionally, tube sheet isolators may be secured one to the condenser fan shroud and one to the evaporator scroll. Hence, the component assembly includes many of the components of the unit including the tube sheet isolators and the subassembly includes the base pan and two heat exchangers.

The component assembly may be slidably engaged to the subassembly by positioning the component assembly above the subassembly such that the tube sheet receiving slots of the isolators act to engage tube sheet 42 of the condenser and tube sheet 32 of the evaporator. The component assembly is then slid relative to the subassembly such that the tube sheet isolators slide along the tube sheets and the component assembly is secured in final position relative to the subassembly. Once in final position, the unit is substantially assembled.

Prior to sliding the component assembly through the subassembly, the evaporator is typically attached to the subassembly only at one end while the condenser is attached at both ends. The loose end of the evaporator is free to rotate such that it may be positioned relative to the component assembly to most readily engage a tube sheet isolator. The condenser fixed to the base pan serves to locate the component assembly in position upon assembly.

Hence, not only does a tube sheet isolator serve to position a heat exchanger relative to the component assembly but additionally serves to provide a sliding surface such that the component assembly may be engaged to the subassembly. Additionally, the tube sheet isolators serve to both thermally and electrically insulate the aluminum tube sheet from the steel air directing component to prevent galvanic corrosion and heat energy dissipation.

The invention has been described in reference to a particular embodiment thereof. It is to be understood by those skilled in the art that variations and modifications can be effected within the spirit and scope of the invention.

We claim:

1. A tube sheet isolator for securing an aluminum heat exchanger having an aluminum tube sheet to a steel component of an air conditioning unit which comprises an elongated body portion having a first planar leg portion and a second leg portion extending therefrom, said second leg portion having a first portion generally parallel to the first leg portion and a flare portion angled in relation to the first leg portion and defining a tube sheet retaining slot therebetween, said body portion including screw receiving means adapted to receive a fastener extending from the component to the screw receiving means such that both the component and the heat exchanger are secured to the tube sheet isolator and wherein the tube sheet isolator is a single article manufactured from an electrically and thermally insulative material to both prevent galvanic action between the aluminum of the heat exchanger and the steel of the component and prevent thermal transfer of heat energy from the heat exchanger to the component of the air conditioning unit.

2. Apparatus for securing a heat exchanger having a tube sheet to another component of an air conditioning unit which comprises a tube sheet isolator, said isolator including a body portion, a first leg portion and a second leg portion, the first and second leg portions being connected to the body portion to form a tube sheet receiving slot therebetween wherein the first leg portion is straight in configuration and wherein the second leg portion includes a flare portion angled away from the first leg portion such that the receiving slot formed by the two leg portions is wider at the ends of the leg portions distant from the body portion than at the ends of the leg portions adjacent the body portions with said body portion including fastening means, wherein the component may be fastened to the isolator by connecting a fastener to secure the component to the isolator and wherein the heat exchanger may be secured to the component by placing the heat exchanger tube sheet into the tube sheet receiving slot formed by the legs of the isolator.

3. The apparatus as set forth in claim 2 wherein the fastening means includes a screw receiving opening extending through the body portion of the isolator and wherein the isolator is manufactured from an electrically and thermally insulative material.

4. The apparatus as set forth in claim 2 and said isolator further including a cap portion affixed to the body portion and extending in a direction opposite a leg portion to abut against an internal member of the air conditioning unit.

5. The apparatus as set forth in claim 2 wherein said isolator is adapted to secure the tube sheet flange with the straight leg portion between the tube sheet flange and the heat exchanger when the tube sheet flange extends to cover a portion of the heat exchanger and when the tube sheet flange extends outwardly away from the heat exchanger the flare leg portion of the isolator is located between the tube sheet flange and return bends extending from the end of the heat exchanger, the isolator being inverted to adapt to either physical arrangement.

* * * * *